US006464368B1

(12) United States Patent
Chen

(10) Patent No.: US 6,464,368 B1
(45) **Date of Patent: *Oct. 15, 2002**

(54) DECORATIVE LAMP ASSEMBLY

(76) Inventor: Ching-Chao Chen, No. 511, Sec. 3, Dong Ta Rd., Hsinchu City (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/953,862

(22) Filed: Sep. 18, 2001

(51) Int. Cl.[7] ..... F21V 33/00

(52) U.S. Cl. ..... 362/96; 362/226; 362/439; 362/360; 362/310; 362/363; 362/318; 362/806; 313/110; 313/111

(58) Field of Search ..... 362/226, 439, 362/360, 310, 363, 101, 318, 253, 806, 811; 313/110, 111

(56) References Cited

U.S. PATENT DOCUMENTS

| | | | | | |
|---|---|---|---|---|---|
| 2,520,691 | A | * | 8/1950 | Otis | |
| 3,780,260 | A | * | 12/1973 | Elsner | 219/271 |
| 4,072,855 | A | * | 2/1978 | Marchese | 362/101 |
| 4,170,035 | A | * | 10/1979 | Walker | 362/31 |
| 5,105,343 | A | * | 4/1992 | Wakimoto | 362/101 |
| 5,683,254 | A | * | 11/1997 | Lin | 439/11 |
| 5,803,580 | A | * | 9/1998 | Tseng | 362/96 |
| 5,860,732 | A | * | 1/1999 | Coleman et al. | 362/253 |
| 6,309,084 | B1 | * | 10/2001 | Lin | 362/101 |

* cited by examiner

*Primary Examiner*—Sandra O'Shea
*Assistant Examiner*—Jacob Y. Choi
(74) *Attorney, Agent, or Firm*—Varndell & Varndell, PLLC

(57) ABSTRACT

A decorative lamp assembly having an ornamental tube for producing air bubbles when radiated by the lamp bulb, the ornamental tube having tiny plastic balls of different colors that move up and down with the air bubbles, which are formed from dichloromethane upon radiation of heat energy from the lamp bulb.

3 Claims, 7 Drawing Sheets

DECORATIVE LAMP ASSEMBLY

BACKGROUND AND SUMMARY OF THE INVENTION

The present invention relates to a decorative lamp assembly and, more particularly, to such a decorative lamp assembly, which causes colored tiny plastic balls to move up and down with air bubbles in an enclosed ornamental tube when turned on to emit light.

FIGS. from 1 through 3 show a decorative lamp assembly 9 according to the prior art. This structure of decorative lamp assembly 9 is comprised of an adapter 91, a bulb 911, lampshade 92, and an ornamental tube 93. The adapter 91 has a socket side adapted to receive the bulb 911, and a plug side adapted to receive power supply from an electric outlet. The lampshade 92 is comprised of an upper shell 921 and a bottom shell 922. The ornamental tube 93 is an enclosed tube of glass material, having a porous bottom stuffing layer 931 formed of sodium silicate ($NaSiO_3$) and silica ($SiO_2$), and an upper stuffing material of dichloromethane ($CH_2Cl_2$) 90. During the fabrication of the ornamental tube 93, sodium silicate ($NaSiO_3$) and silica ($SiO_2$) are put in the tube and heated to about 30°~35° C. When cooled down, sodium silicate is condensed and bonded to the inside wall of the tube. After formation of the porous bottom stuffing layer 931, dichloromethane 90 is put in the tube with a space left above dichloromethane 90, and then the tube is sealed after exhaust of air. The lampshade 92 is fastened to the adapter 91 around the bulb 911. The ornamental tube 93 is fastened to the top side of the upper shell 921 of the lampshade 92, keeping the bottom end suspended above the bulb 911. When turning on the bulb 911, heat energy is transmitted from the bulb 911 through the porous bottom stuffing layer 931 to the upper stuffing material of dichloromethane 90 to boil dichloromethane 90 into air bubbles 900. At the same time, light rays pass from the bulb 911 through the porous bottom stuffing layer 931 and the bubbles 900, producing a lighting effect. The visual effect produced during working of the decorative lamp assembly 9 is less attractive.

The present invention has been accomplished under the circumstances in view. It is the main object of the present invention to provide a decorative lamp assembly, which produces a fantastic visual effect when operated. According to the present invention, tiny plastic balls of different colors are put in the space inside the ornamental tube above the upper stuffing material of dichloromethane. When boiling the upper stuffing material of dichloromethane into air bubbles, the colored tiny plastic balls are forced to move up and down with the air bubbles.

DETAILED DESCRIPTION OF THE PREFERRED EMBODIMENT

Figure 1:
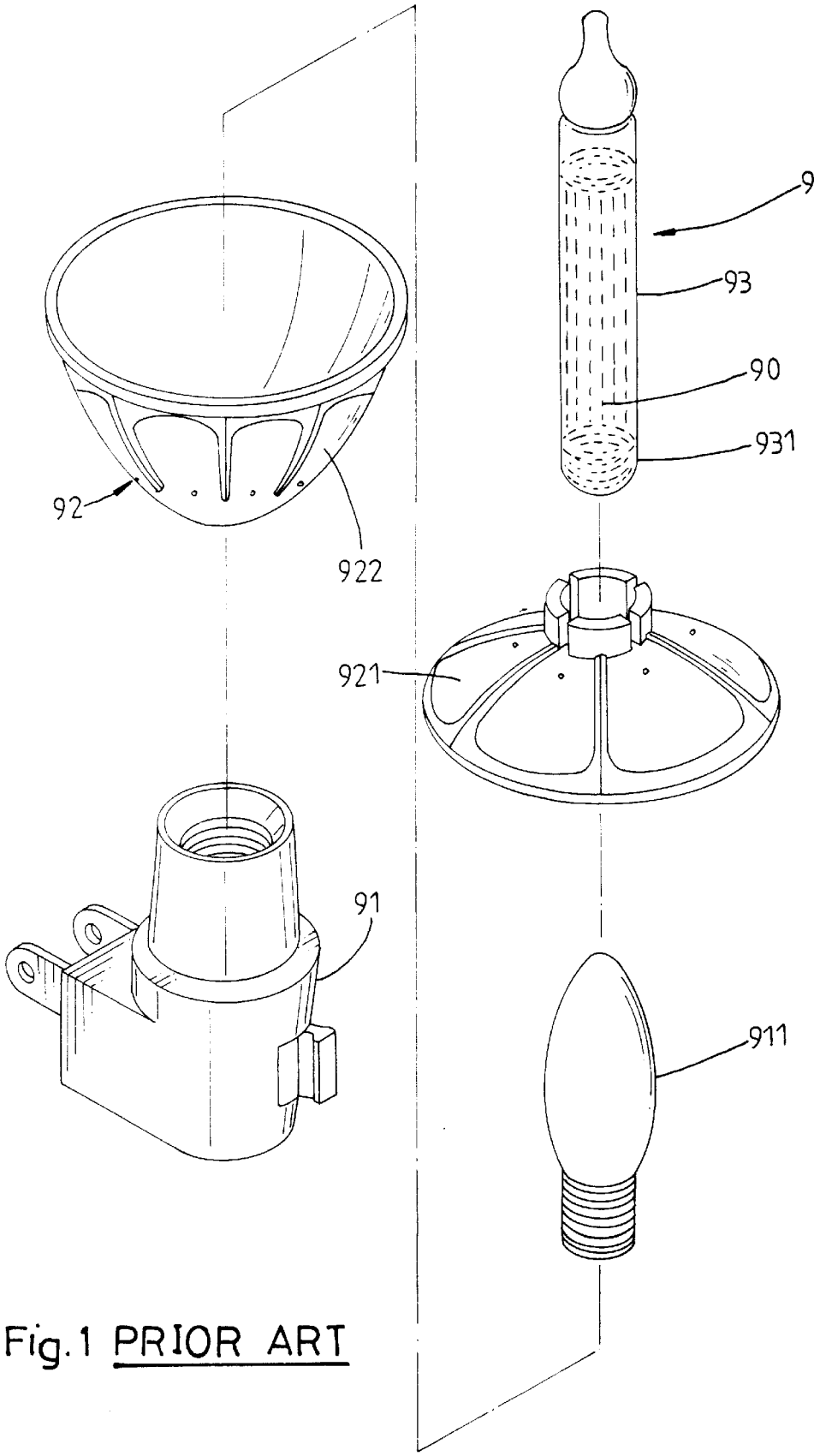
Fig. 1 PRIOR ART
FIG. 1 is an exploded view of a decorative lamp assembly according to the prior art.
Figure 2:
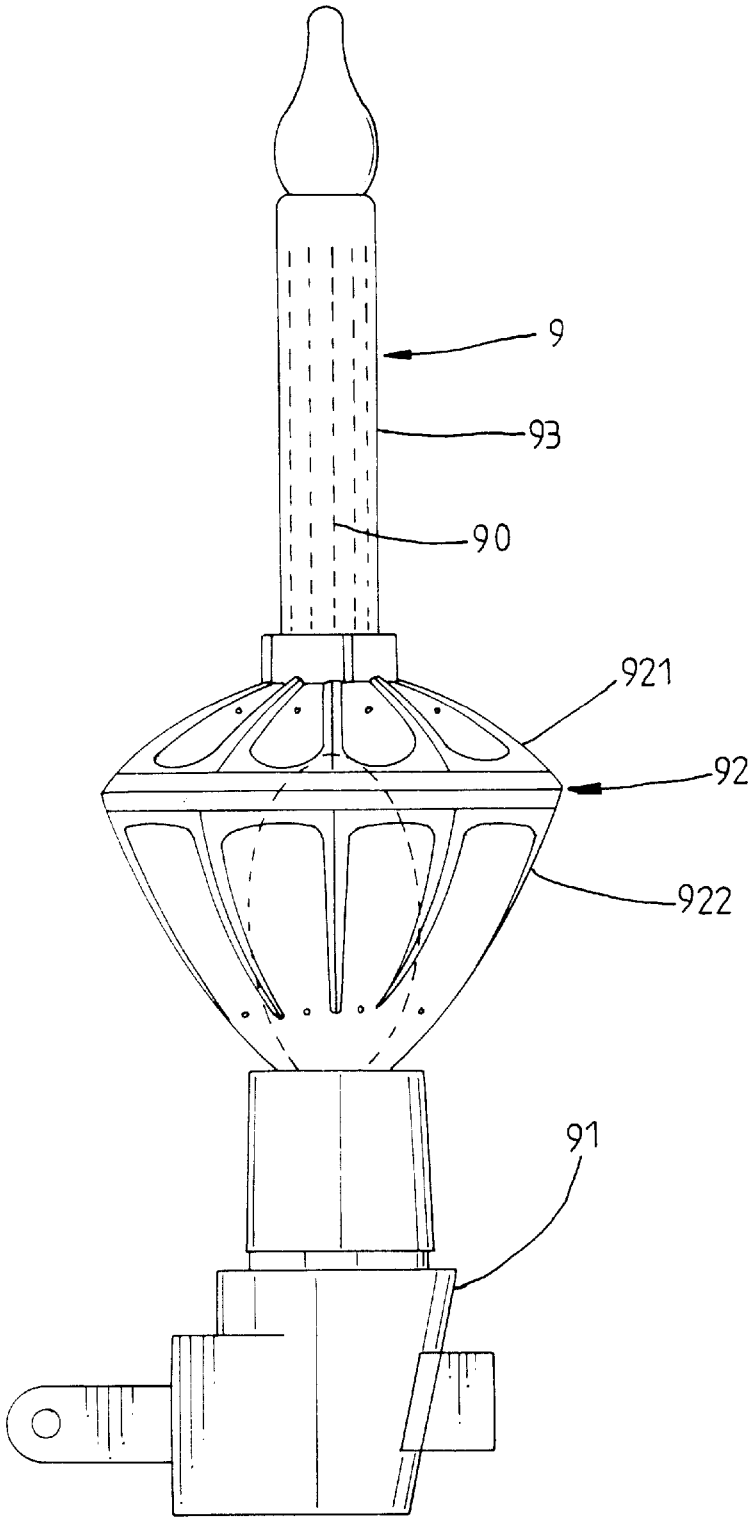
Fig. 2 PRIOR ART
FIG. 2 is a plain view of the decorative lamp assembly according to the prior art.
Figure 3:
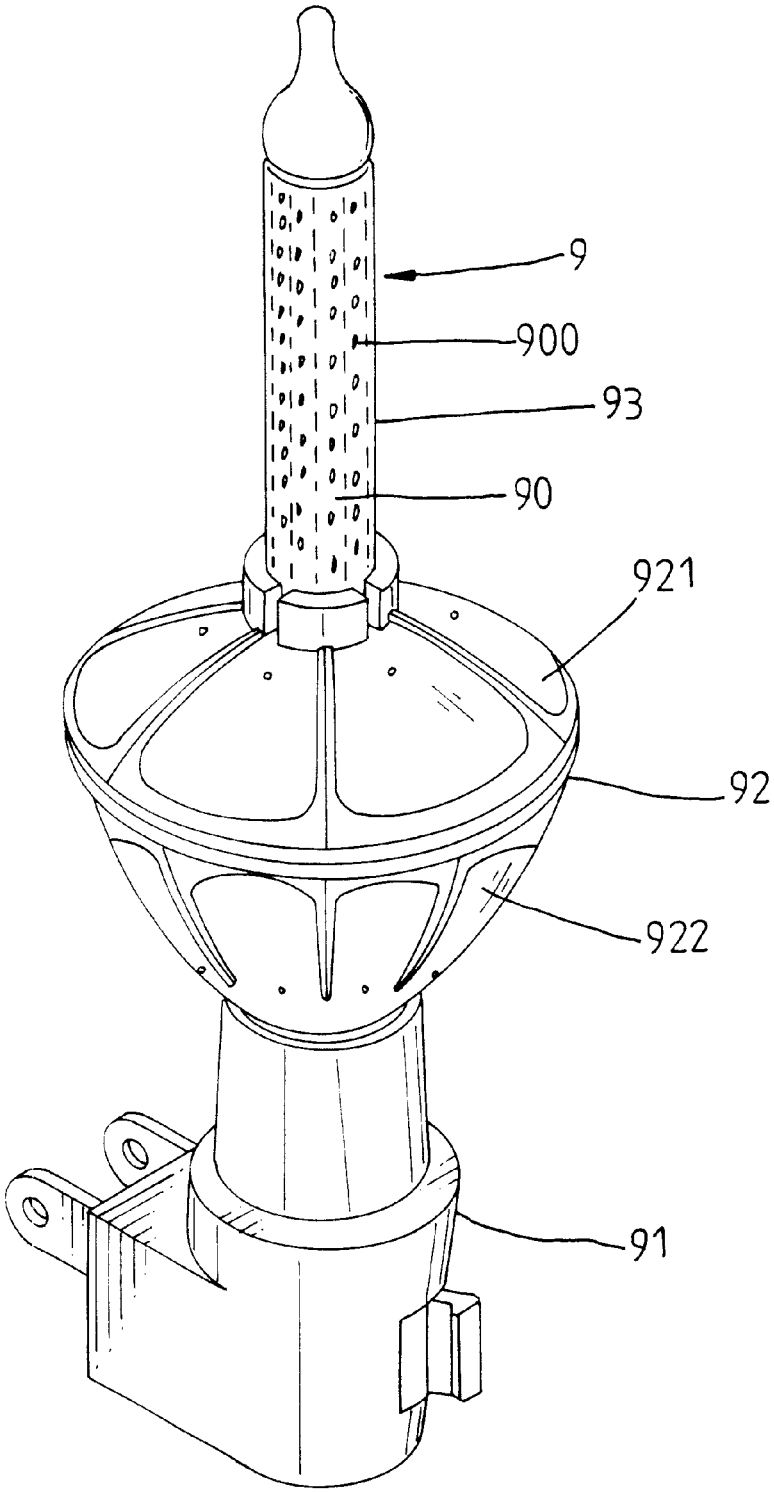
Fig. 3 PRIOR ART
FIG. 3 is an applied view of the decorative lamp assembly according to the prior art, showing air bubbles produced in the ornamental tube.
Figure 4:
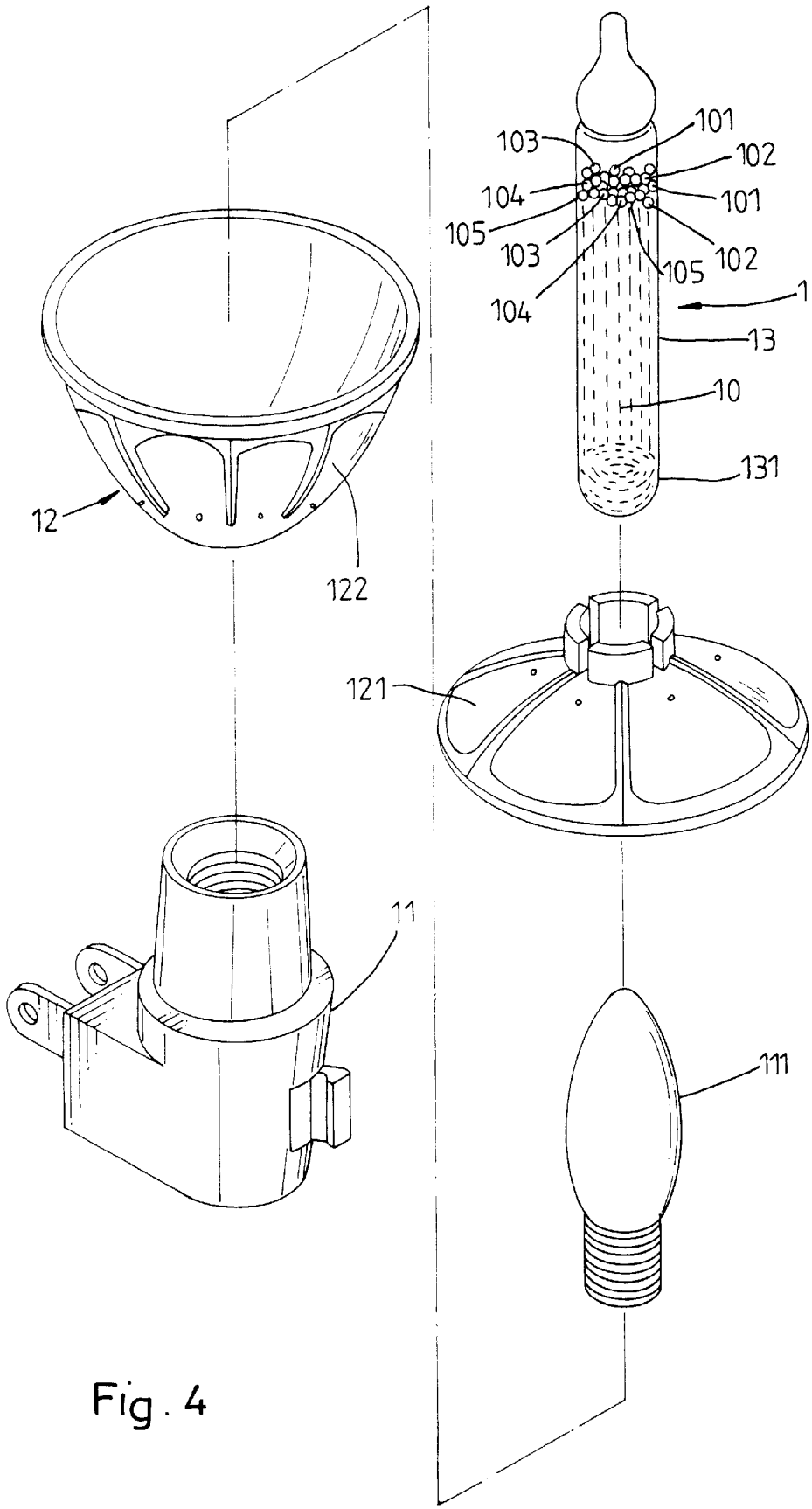
FIG. 4 is an exploded view of a decorative lamp assembly according to the present invention.
Figure 5:
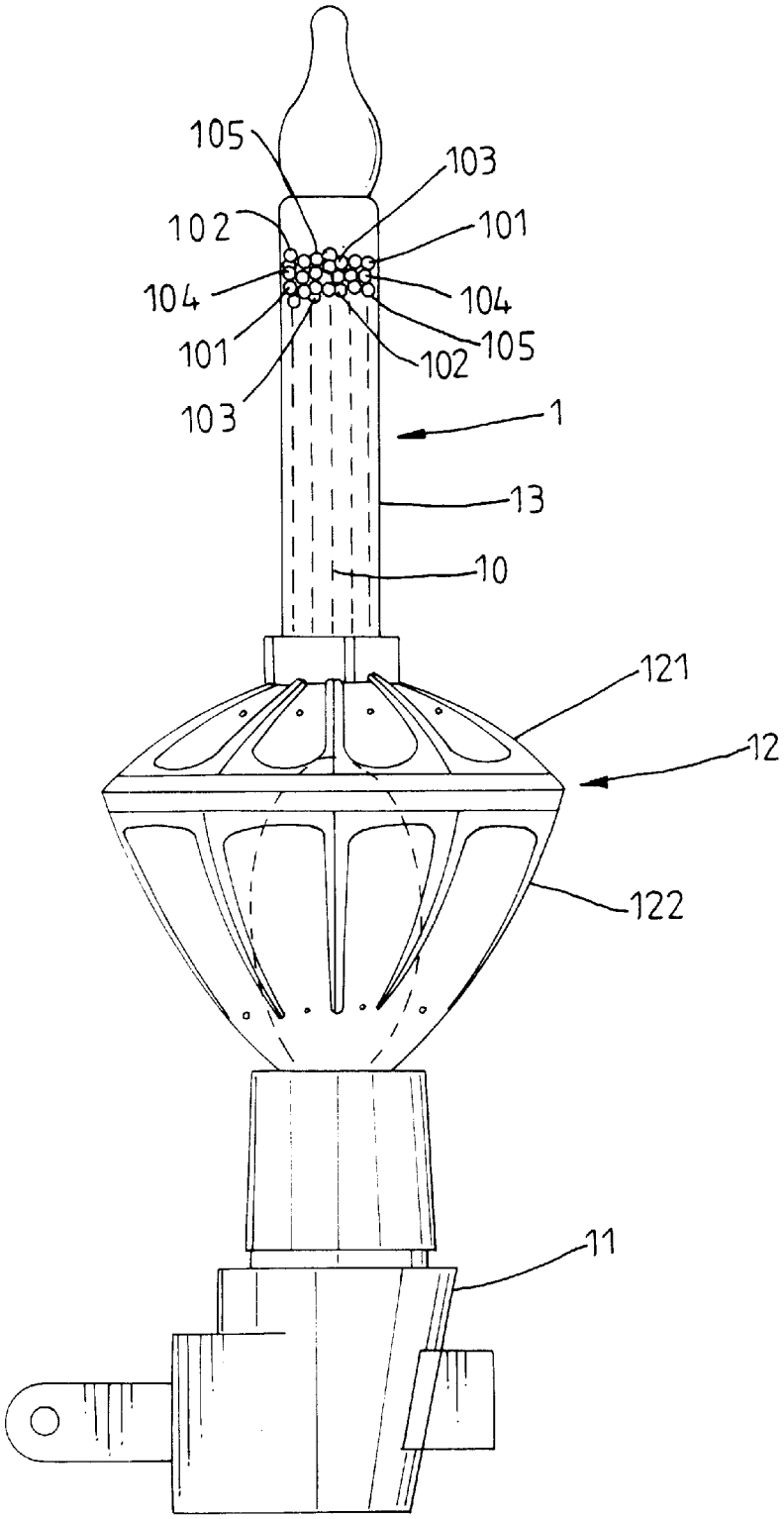
FIG. 5 is a plain view of the decorative lamp assembly according to the present invention.
Figure 6:
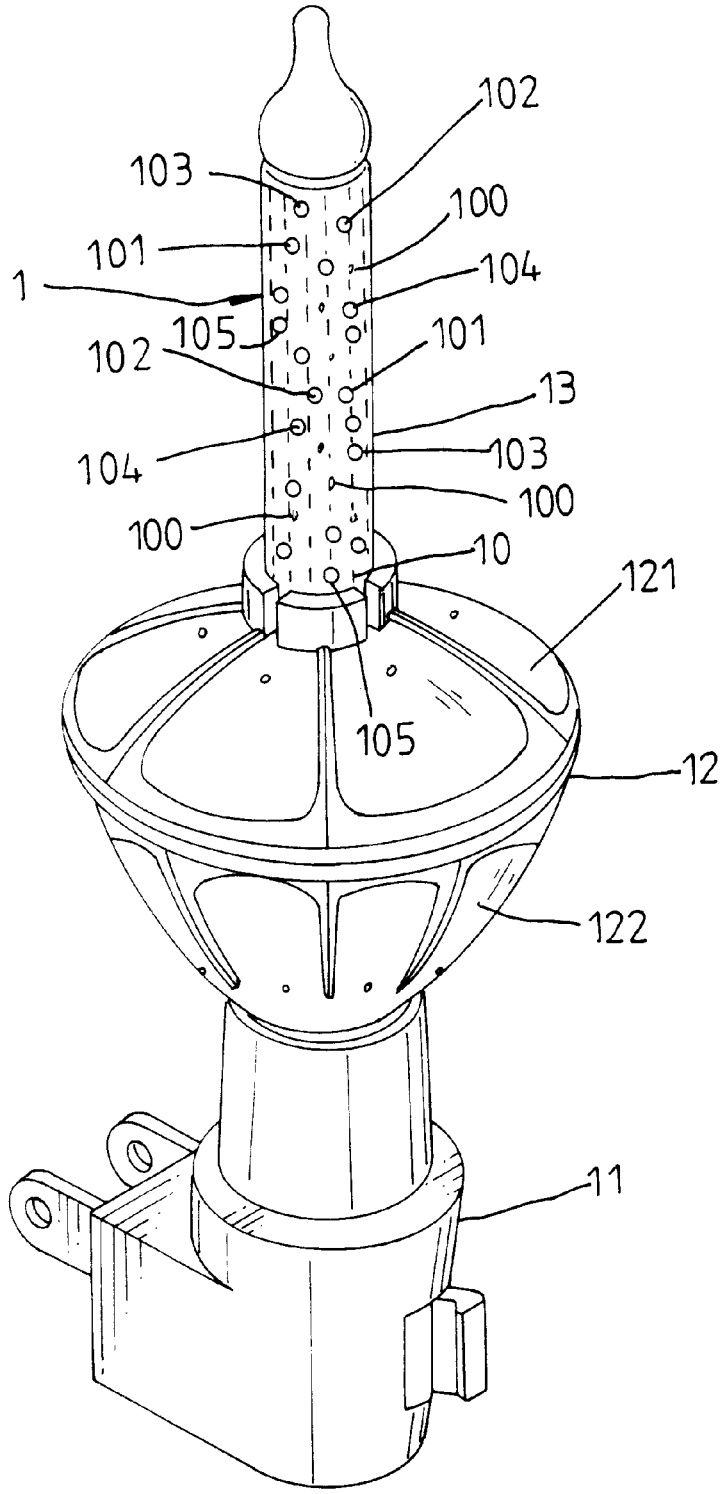
FIG. 6 is an applied view of the present invention showing air bubbles produced in the ornamental tube, the colored tiny plastic balls moved up and down with the air bubbles.

Referring to FIGS. from 4 through 6, a decorative lamp assembly 1 is shown comprised of an adapter 11, a bulb 111, lampshade 12, and an ornamental tube 13. According to this embodiment, the adapter 11 has a socket side adapted to receive the bulb 111, and a plug side adapted to receive power supply from an electric outlet. The lampshade 12 is comprised of an upper shell 121 and a bottom shell 122. The ornamental tube 13 is an enclosed tube of glass material, having a porous bottom stuffing layer 131 formed of sodium silicate ($NaSiO_3$) and silica ($SiO_2$), and an upper stuffing material of dichloromethane ($CH_2Cl_2$) 10. During the fabrication of the ornamental tube 13, sodium silicate ($NaSiO_3$) and silica ($SiO_2$) are put in the tube and heated to about 300~35° C. When cooled down, sodium silicate is condensed and bonded to the inside wall of the tube. After formation of the porous bottom stuffing layer 131, dichloromethane 10 is put in the tube with a space left above dichloromethane 10, and then the tube is sealed after exhaust of air. The lampshade 12 is fastened to the adapter 11 around the bulb 111. The ornamental tube 13 is fastened to the top side of the upper shell 121 of the lampshade 12, keeping the bottom end suspended above the bulb 111. When turning on the bulb 111, heat energy is transmitted from the bulb 111 through the porous bottom stuffing layer 131 to the upper stuffing material of dichloromethane 10 to boil dichloromethane 10 into air bubbles 100 (see FIG. 6). At the same time, light rays pass from the bulb 111 through the porous bottom stuffing layer 131 and the bubbles 100, producing a lighting effect.

As an alternate form of the present invention, a compound of low boiling point is used instead of dichloromethane 10.

Figure 7:
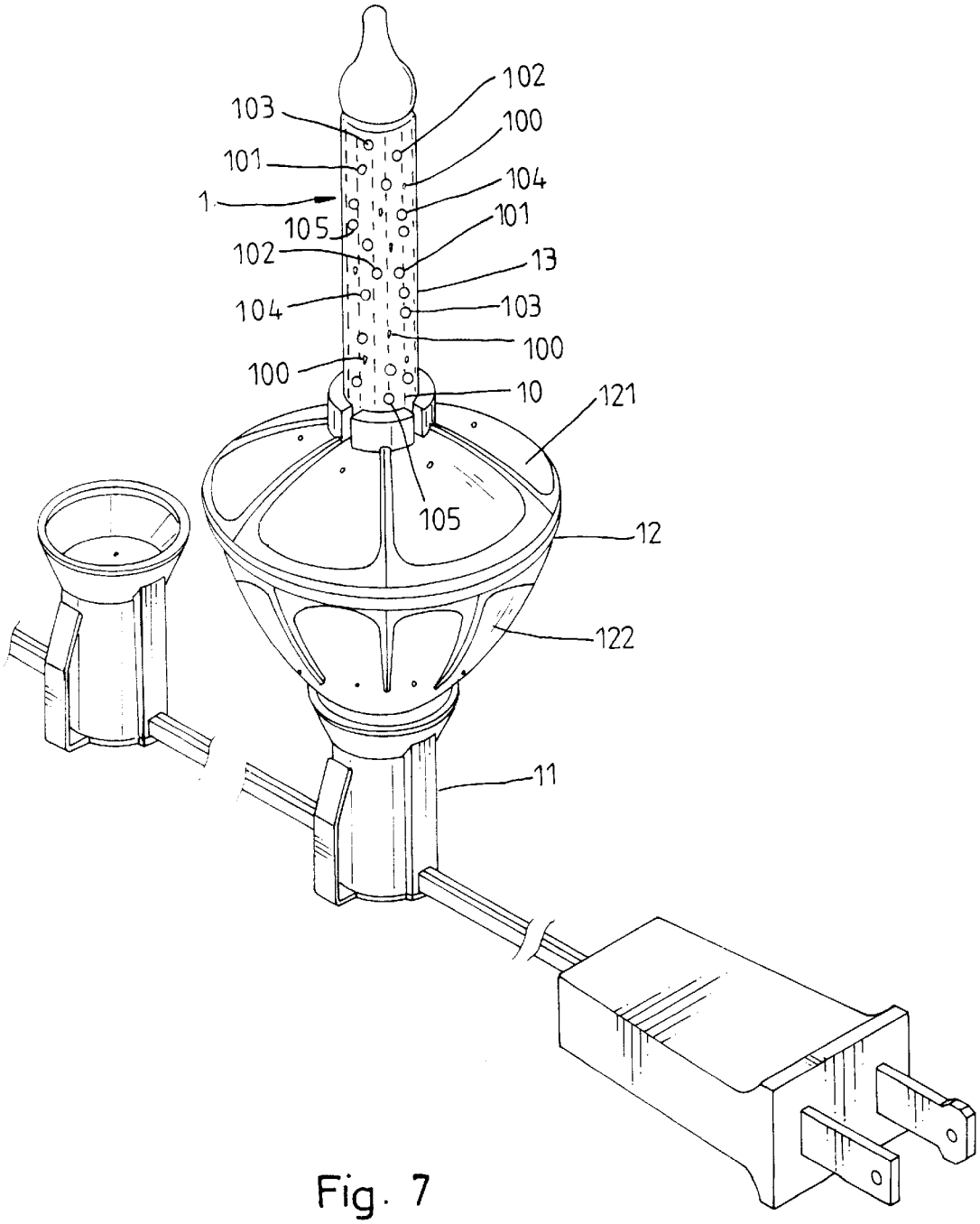
FIG. 7 shows an alternate form of the present invention.

Referring to FIG. 7, the adapter 11 is a light set having a socket adapted to receive the bulb 111 and to hold the lampshade 12 around the bulb 111 (the bulb 111 is not seen in FIG. 7).

A prototype of decorative lamp assembly has been constructed with the features of FIGS. 4~7. The decorative lamp assembly functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A decorative lamp assembly comprising a lamp bulb, an adapter adapted to obtain power supply for said bulb, a lampshade fastened to said adapter around said lamp bulb, and an ornamental tube fastened to said lampshade above said lamp bulb and adapted to receive heat and light from said lamp bulb upon operation of said lamp bulb, said ornamental tube comprising an enclosed tube body sealed after exhaust of air, a porous bottom stuffing layer formed of sodium silicate ($NaSiO_3$) and silica ($SiO_2$) and fixedly disposed at a bottom side inside said enclosed tube body, an upper stuffing material of chemical compound of boiling point below 39° C. disposed inside said enclosed tube body above said porous bottom stuffing layer and adapted to produce bubbles when heated by heat energy from said lamp bulb upon operation of said lamp bulb, and a space left inside said enclosed tube body above said upper stuffing material, wherein said ornamental tube further comprises a plurality of tiny plastic balls of different colors disposed in the space inside said enclosed tube body above said upper stuffing material.

2. The decorative lamp assembly as claimed in claim 1 wherein said upper stuffing material of chemical compound is dichloromethane.

3. The decorative lamp assembly as claimed in claim 1 wherein said enclosed tube body is made of glass.

* * * * *